US009944355B1

(12) United States Patent
Stackpole et al.

(10) Patent No.: US 9,944,355 B1
(45) **Date of Patent: *Apr. 17, 2018**

(54) LATTICE STRUCTURE EQUIPPED HYDRODYNAMIC SUBMERSIBLE REMOTELY OPERATED VEHICLE

(71) Applicant: OPENROV INC., Berkeley, CA (US)

(72) Inventors: Eric Stackpole, Berkeley, CA (US); Colin Ho, Berkeley, CA (US)

(73) Assignee: OPENROV INC., Berkeley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/621,787

(22) Filed: Jun. 13, 2017

Related U.S. Application Data

(63) Continuation of application No. 15/285,255, filed on Oct. 4, 2016, now Pat. No. 9,694,874.

(51) Int. Cl.
*B63B 22/00* (2006.01)
*B63B 3/13* (2006.01)
*B63G 8/00* (2006.01)

(52) U.S. Cl.
CPC ..... *B63B 3/13* (2013.01); *B63B 22/00* (2013.01); *B63G 8/001* (2013.01); *B63G 2008/005* (2013.01)

(58) Field of Classification Search
CPC ..... B63G 2008/001; B63G 2008/005; B63G 8/001; B63B 3/13; B63B 22/00
USPC ..... 114/312
See application file for complete search history.

(56) References Cited

U.S. PATENT DOCUMENTS

| | | | | |
|---|---|---|---|---|
| 5,727,496 | A | 3/1998 | Welch, Jr. | |
| 9,694,874 | B1 * | 7/2017 | Stackpole | B63B 3/13 |
| 2010/0212573 | A1 | 8/2010 | Hawkes et al. | |
| 2013/0157526 | A1 | 6/2013 | Martin | |
| 2013/0239869 | A1 | 9/2013 | Hesse et al. | |

OTHER PUBLICATIONS

International Search Report received in PCT/US2017/054163, dated Oct. 25, 2017, 7 pages.

* cited by examiner

*Primary Examiner* — Anthony D Wiest
(74) *Attorney, Agent, or Firm* — Arc IP Law, PC; Joseph J. Mayo

(57) ABSTRACT

A submersible remotely operated vehicle with a streamlined shape, which uses an internal support lattice to provide pressure resistance. By using a lattice frame to distribute the water pressure load on the vehicle, the vehicle may be constructed of thin-walled, injection molded plastic, yet may be capable of diving to significant depths. The vehicle may provide pitch control using a single vertical thrust actuator that is horizontally fore or aft of the center of vertical drag; this efficient pitch control improves hydrodynamic efficiency by pointing the vehicle towards the direction of travel to minimize the coefficient of drag. The vehicle may communicate wirelessly with a remote operator via a communications buoy tethered to the vehicle, thereby eliminating cabling constraints on the vehicle's range from the operator. The tether may be connected to the buoy using a waterproof connector that presses three terminals surrounded by a compliant seal onto mating contacts.

15 Claims, 14 Drawing Sheets

LATTICE STRUCTURE EQUIPPED HYDRODYNAMIC SUBMERSIBLE REMOTELY OPERATED VEHICLE

This application is a continuation of U.S. Utility patent application Ser. No. 15/285,255 filed 4 Oct. 2016, the specification of which is hereby incorporated herein by reference.

BACKGROUND OF THE INVENTION

Field of the Invention

One or more embodiments of the invention are related to the field of underwater vehicles. More particularly, but not by way of limitation, one or more embodiments of the invention enable a remotely operated submersible vehicle with a hydrodynamic design that incorporates an internal support lattice.

Description of the Related Art

Underwater vehicles such as submarines must be designed to withstand the pressure of the underwater environment, which can be extreme at significant depths. Therefore these vehicles are typically designed with pressure hulls that are cylindrical or spherical, since these shapes provide inherent rigidity due to their circular cross sections. However, these cylindrical or spherical shapes are not hydrodyamically efficient compared to more streamlined shapes. One solution to this tradeoff between pressure resistance and hydrodynamics is to add an external hydrodynamic shell around a pressure hull; however, this solution adds weight, complexity, and cost to an underwater vehicle. There are no known designs for a submersible vehicle that provide a hydrodynamic shape for the pressure hull itself.

For hydrodynamic efficiency, an underwater vehicle must also be pointed in the direction of travel through the water in order to minimize the drag coefficient. In general, this requires actuators to modify the pitch of the vehicle. Known solutions require multiple actuators to control pitch. There are no known designs for a submersible vehicle that use a single actuator to provide vertical thrust and to simultaneously control the pitch of the vehicle.

For at least the limitations described above there is a need for a hydrodynamic submersible remotely operated vehicle.

BRIEF SUMMARY OF THE INVENTION

One or more embodiments described in the specification are related to a hydrodynamic submersible remotely operated vehicle. Embodiments of the system may have a pressure hull shaped for a low coefficient of drag, with an internal support lattice to provide pressure resistance. Embodiments may also employ an actuator offset horizontally from the center of vertical drag in order to provide both vertical thrust and vertical pitch.

One or more embodiments of the system have a pressure hull with a cross section that is noncircular along any cutting plane that bisects the hull's interior. In particular, one or more embodiments have pressure hulls that are neither cylindrical nor spherical, in contrast to existing designs known in the art. With noncircular pressure hull shapes, the submersible vehicle can be considerably more hydrodynamic. To provide sufficient pressure resistance with these noncircular hull shapes, one or more embodiments incorporate an internal support frame inside the pressure hull. The support frame may contact the inner surface of the pressure hull at several support points, and may provide a resistive force against compression of the hull when the hull is submerged. One or more embodiments may provide actuators and sensors coupled to, integrated into, within, or otherwise connected to the pressure hull. The actuators may for example provide propulsion to move the submersible vehicle when it is submerged. The sensors may provide data that contains observations of the surrounding environment, such as for example video of the undersea area. One or more embodiments may contain communications electronics that transmit signals between the submersible vehicle and a remote operator. Signals may include control signals for actuators sent by the operator to control the vehicle, and sensor data sent from the vehicle back to the operator.

The internal support frame may include any desired number, size, shape, and pattern of support walls, panels, columns, beams, ribs, or trusses. In one or more embodiments these structures may contact the inner surface of the pressure hull at multiple points on either side of any plane that bisects the hull's interior. In one or more embodiments the support frame or portions thereof may contain walls, columns, beams, ribs, or panels in a lattice pattern. The lattice may be of any regular or irregular shape and pattern, including for example, without limitation, a triangular lattice, a hexagonal lattice, and a rectangular lattice. One or more embodiments may use a dense lattice with a large number of repeated shapes such as polygons; for example, in one or more embodiments a cross section of the lattice structure may contain 20 or more vertices.

By using for example a lattice structure as a support frame, one or more embodiments may use injection molded plastic for all or portions of the pressure hull and the support frame. Although injection molded plastic parts are typically relatively thin, for example with widths of only a few millimeters, the internal support lattice may provide sufficient rigidity to the structure that the hull can withstand considerable pressure at significant depths. This combination of thin material, manufactured for example with injection molding, and the ability to dive to substantial depths, is not known in the art. One or more embodiments of the system may for example have pressure hulls with maximum widths of 7 millimeters or less, and with average widths of 4 millimeters or less. Even with these thin hulls, one or more embodiments may be able to resist external pressure of 1200 kPa or in some cases of 2400 kPa or more.

One or more embodiments may use a vertical thrust actuator that is horizontally offset from the center of vertical drag, in order for example to provide both pitch control and vertical motion using a single actuator. The vertical thrust actuator may provide a vertical force to move the submersible vehicle vertically, as well as a torque since the actuator is offset fore or aft of the center of vertical drag. The torque may be used to control the pitch angle of the submersible vehicle. In one or more embodiments the vehicle may have a righting moment when it is not horizontal, and the torque from the vertical thrust actuator around the center of vertical drag may counteract the righting moment to maintain a nonzero pitch angle. For example, in one or more embodiments the vertical thrust actuator may provide sufficient torque to attain and maintain a pitch angle of 30 degrees or more.

In one or more embodiments the submersible vehicle's communications electronics may relay signals to a remote operator via a communications buoy. The buoy for example may be connected to the submerged vehicle via a cable, and the buoy may communicate wirelessly with a remote operator. The buoy may include for example one or more of a GPS receiver, a locator light, or a speaker to facilitate locating the buoy and the vehicle. The buoy may be designed to rest stably on a flat surface such as a table or level ground, with the antenna upright, which allows the system to work well without necessarily being fully deployed in the water.

One or more embodiments may utilize an innovative connector design, for example to connect the communications cable from the vehicle to the communications buoy. The connector may use a pressure fit between terminals in the connector and mating connectors on the buoy. The terminals in the connector may be surrounded by a sealing pad that is made of a compliant, water resistant material to seal the conductive paths when the connector is connected. A central screw for example between the terminals may be attached to the buoy's receiving panel to apply pressure to make the connection. In one or more embodiments the connector may use three or fewer terminals to ensure a wobble-free connection. In one or more embodiments the sealing pad may be separate from the connector body, for example to support easy replacement; the sealing pad may for example fit into indentations in the connector body that compress the compliant material to create a sufficient seal around each contact pin.

One or more embodiments may utilize a magnetic filter around one or more brushless outrunner DC motors, such as motors that drive the thrust actuators of the underwater vehicle. The magnetic filter may use a ring magnet that surrounds part of the outer surface of the rotating motor bell of the brushless motor. Suspended particles in the water may be drawn into a gap between the ring magnet and the outer surface of the motor bell, and may therefore be prevented from entering the motor itself.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION OF THE INVENTION

A hydrodynamic submersible remotely operated vehicle will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
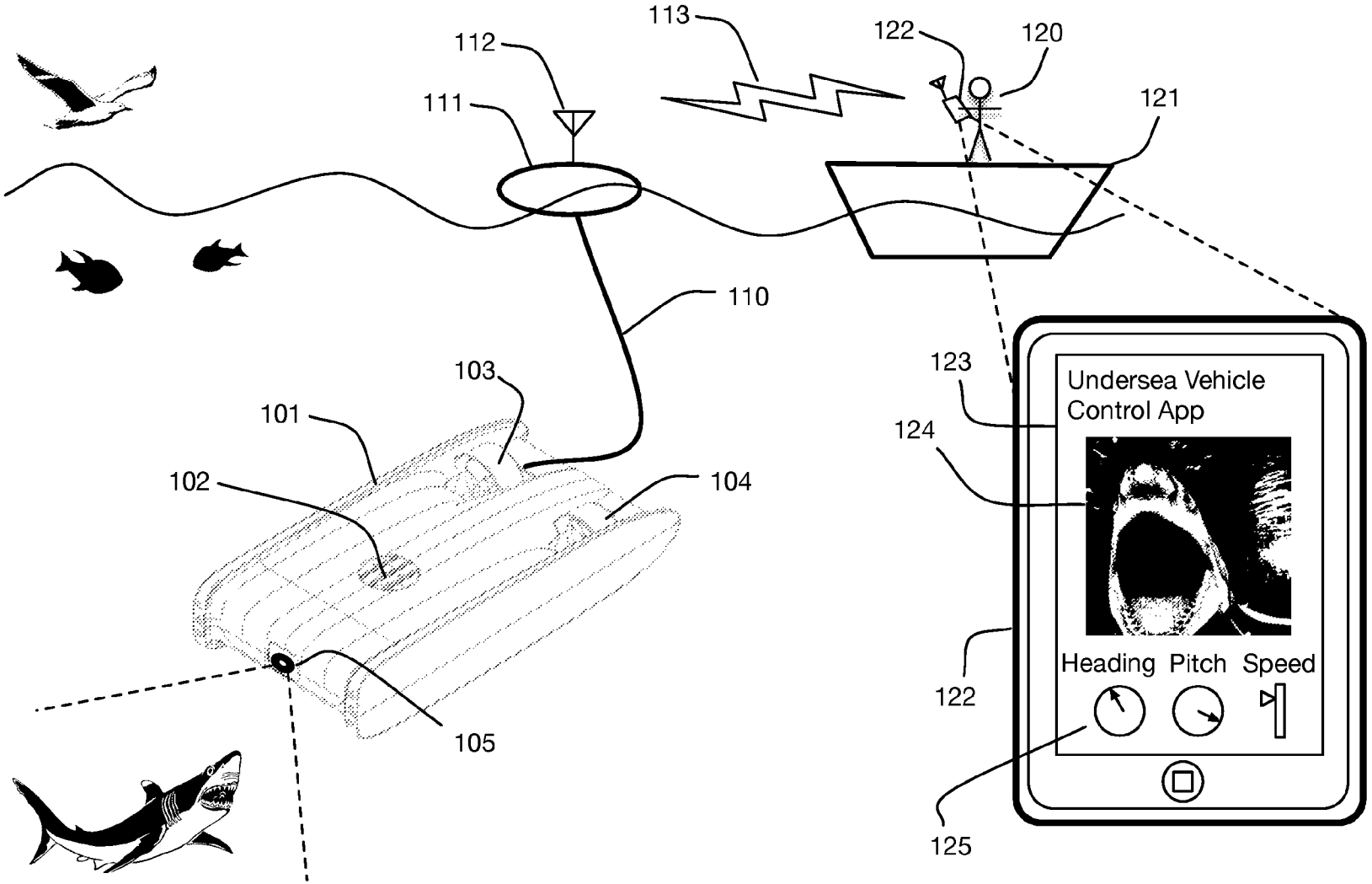
FIG. 1 shows an overview of an embodiment of the system, which includes a remotely operated submersible vehicle with a noncircular shape, in communication with a remote operator via a communications buoy connected by a cable to the vehicle.

FIG. 1 shows an overview of components of an embodiment of the system. Submersible remotely operated vehicle 101 includes various actuators and sensors. For example, vehicle 101 may have horizontal thrusters 103 and 104, and vertical thruster 102. These actuators are illustrative; one or more embodiments may have any number and any type of actuators to control motion or to control any portion of the vehicle. For example, without limitation, actuators may include any or all of propellers, jets, rudders, trim tabs, stabilizers, moveable arms or grippers, ballast controls, or pumps. Actuators may be placed in any location on, within, or near vehicle 101. Vehicle 101 may have any number of and any type or types of sensors. For example, in the embodiment illustrated in FIG. 1, vehicle 101 has camera sensor 105 at the front of the vehicle, to observe the underwater environment. Sensors may include for example, without limitation, cameras capturing images in visible or invisible spectra, acoustic sensors, thermometers, pressure sensors, accelerometers, magnetometers, gyroscopes, GPS receivers, and ultrasonic rangefinders.

In one or more embodiments, vehicle 101 is a remotely operated vehicle that is controlled by an operator located away from the vehicle. In one or more embodiments the vehicle 101 may be fully or partially autonomous, as well as or in addition to accepting control from a remote operator. A remote operator may be one or more human operators, a computer control, or combinations of human and computer control. In the embodiment of FIG. 1, remote operator 120 is a human operator located on a surface vessel 121. One or more embodiments may support remote operators in any location or locations, including on surface vessels, on land, airborne, or in other submersible vehicles. In the embodiment of FIG. 1, submersible vehicle 101 communicates with remote operator 120 via a wireless communications buoy 111 that is attached to the vehicle via communications tether 110. The buoy floats on the surface of the water, and communicates wirelessly using antenna 112, which sends signals over channel 113 to remote operator station 122 used by remote operator 120. The buoy 111 may be implemented with a hydrodynamic shape so that it can be towed easily and efficiently by the remote vehicle 101. The buoy may also be shaped so that it can rest stably on a flat surface, such as a table or level ground, when not in the water, with antenna 112 upright and usable in this configuration. For example, the buoy may have vertical fins that form a tripod shape, rather than having a single keel in the center. This stability feature allows the system to be easily tested and configured prior to launching in the water. For short-range operation, the buoy may also remain on ground or on a ship while the vehicle is deployed in the water. One or more embodiments may use any wireless or wired communication media, or any combination thereof, between vehicle 101 and remote operator station 122, including but not limited to the mixed system shown in FIG. 1 that uses a wired link between the vehicle 101 and the buoy 111, and a wireless link between buoy 111 and station 122. One or more embodiments may not require a communications buoy, and may support communication directly between the vehicle and the remote operator station. A potential advantage of a communications buoy like 111 compared to a direct wireless link between the operator and the vehicle is that wireless signals may propagate poorly through water; thus a wired link to a surface buoy may provide a more reliable and higher bandwidth communications link. However, one or more embodiments may use other configurations. For example, one or more embodiments may use a cable between the remote operator station 122 and the vehicle 101; this configuration provides high bandwidth communication but has the disadvantage of limiting the range of the vehicle based on cable. One or more embodiments may use wireless communication between the remote operator station 122 and the vehicle 101, albeit at potentially lower transmission rates than the buoy relayed communication illustrated in FIG. 1.

In one or more embodiments with a communications buoy, the buoy may also provide power for the remotely operated vehicle 101, for example over cable 110. Such a configuration may reduce the weight and size of the vehicle 101. Power may be for example provided by a battery, by an engine, by solar power, or by any combination thereof. In one or more embodiments the remote vehicle 101 may have an integrated power supply. In embodiments with local power in the remote vehicle, the vehicle may supply power to the buoy. Embodiments may therefore place power in either the buoy only (and power the vehicle from the buoy), in the vehicle only (and power the buoy from the vehicle), or in both the vehicle and the buoy. One or more embodiments may employ a combination of locally integrated power in the vehicle and remotely supplied power from a buoy or from another source such as the remote operator station.

In the embodiment illustrated in FIG. 1, remote operator station 122 is used by remote operator 120 to receive and display signals from sensors (such as camera 105), and to control actuators such as the thrusters 102, 103, and 104. FIG. 1 shows an illustrative user interface for a remote operator station as app 123 running on a tablet computer 122. This user interface hardware and software are illustrative; one or more embodiments may use any device or devices with any type or types of software to control the remotely operated vehicle. The illustrative app 123 displays video 124 from camera 105, and it has motion controls 125 that control the thrusters 102, 103, and 104 of the vehicle.

Figure 2:
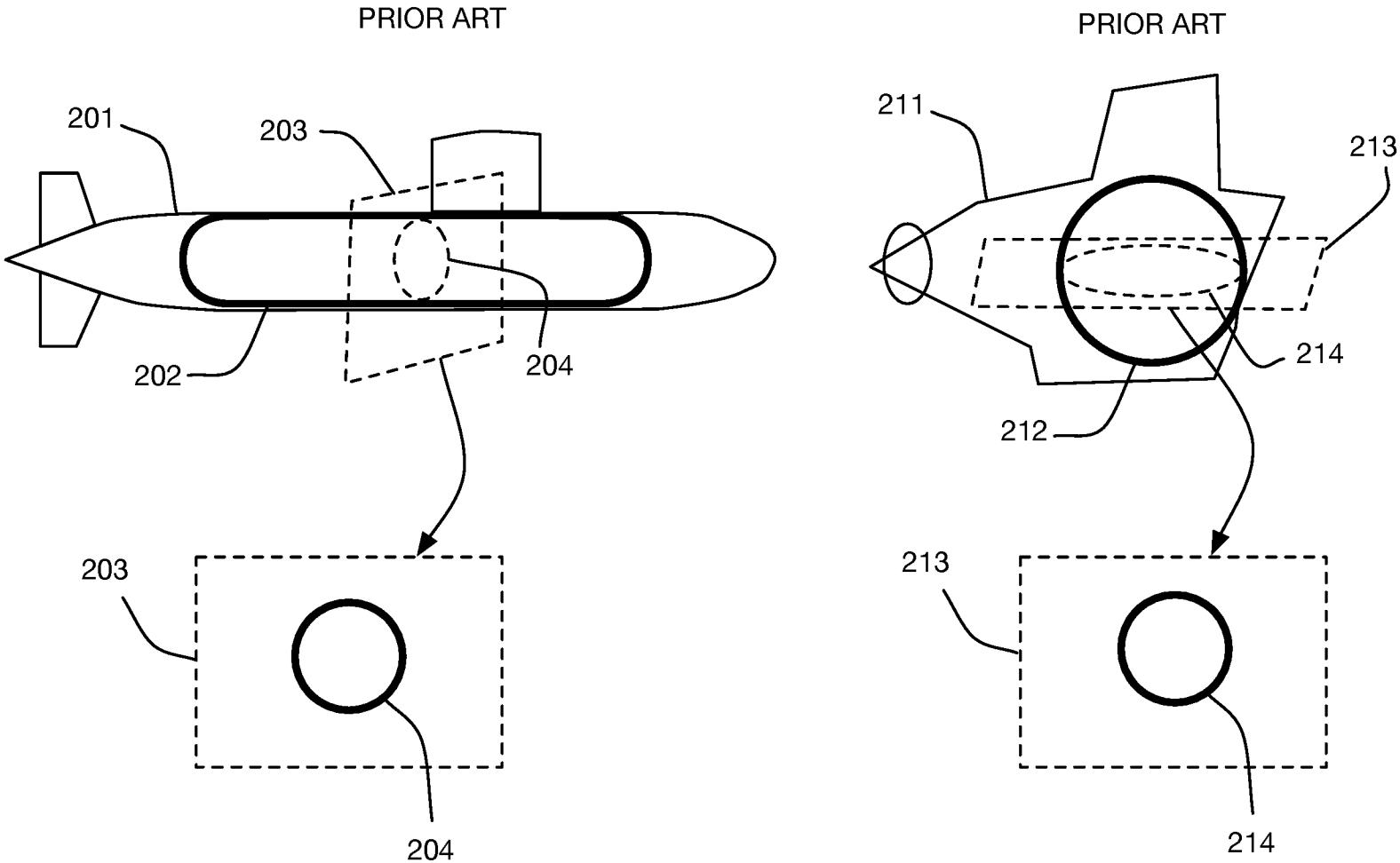
FIG. 2 shows illustrative shapes for pressure hulls utilized in the prior art; these pressure hulls typically have circular cross sections for inherent rigidity and pressure resistance.

One or more embodiments of the system may use a pressure hull with a shape that is more hydrodynamic than the shapes typically used for pressure hulls in the art. FIG. 2 illustrates pressure hull shapes used in the prior art. These pressure hulls are generally cylindrical or spherical because the circular cross sections of the hulls provide optimal pressure resistance. For example, submarine 201 has a cylindrical pressure hull 202, which has a circular cross section 204 with plane 203 that bisects the pressure hull 202 perpendicularly to the submarine's long axis. Diving vessel 211 (similar to some deep sea research vessels, for example) has a pressure hull 212 that is spherical in order to withstand the extreme pressures of the deep sea environment. This pressure hull 212 has a circular cross section along any bisecting plane, such as for example circle 214 for the cross section with horizontal plane 213. In general, prior art submersible vehicles have pressure hulls with circular cross sections along one or more planes.

Figure 3:
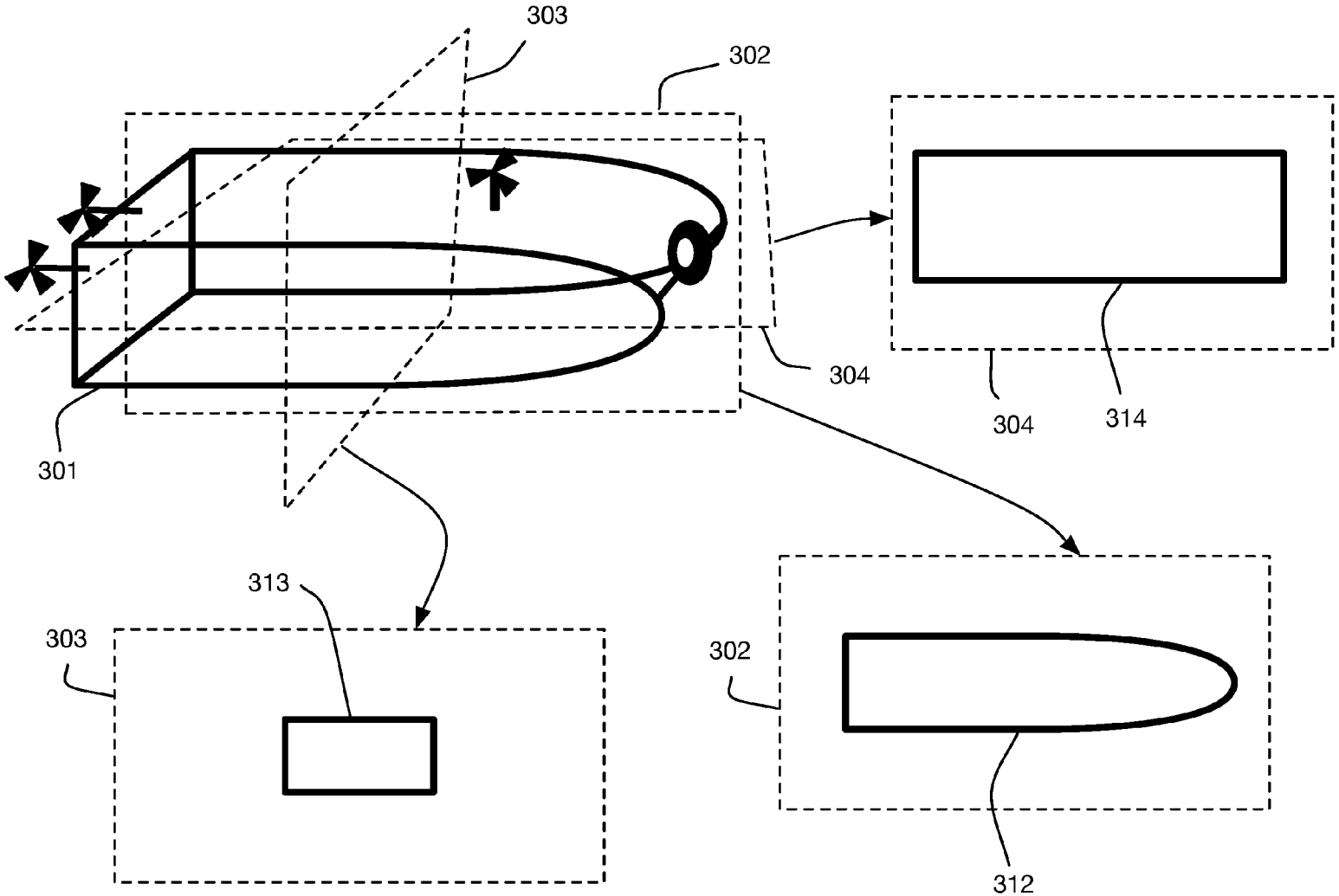
FIG. 3 illustrates a conceptual pressure hull shape used in one or more embodiments of the system, which has noncircular cross sections.

One or more embodiments of the system have pressure hulls with hydrodynamic shapes. These shapes may not have circular cross sections along any plane that bisects the hull's interior. FIG. 3 shows an illustrative pressure hull shape 301, which provides greater hydrodynamic efficiency compared to the hull shapes shown in FIG. 2. This hull shape 301 is similar to that of submersible vehicle 101 of FIG. 1, but is somewhat simplified for illustration. This shape 301 does not have a circular cross section along any plane that bisects the hull's interior. For example, the hull cross section with vertical plane 302 along the longitudinal axis is shape 312; the hull cross section with vertical plane 303 along the lateral axis is shape 313; and the hull cross section with horizontal plane 304 is shape 314. None of these cross sectional shapes is circular in at least one embodiment of the invention. As a result of the streamlined shape of hull 301, the submersible vehicle has a lower coefficient of drag and is therefore more hydrodynamically efficient.

Figure 4:
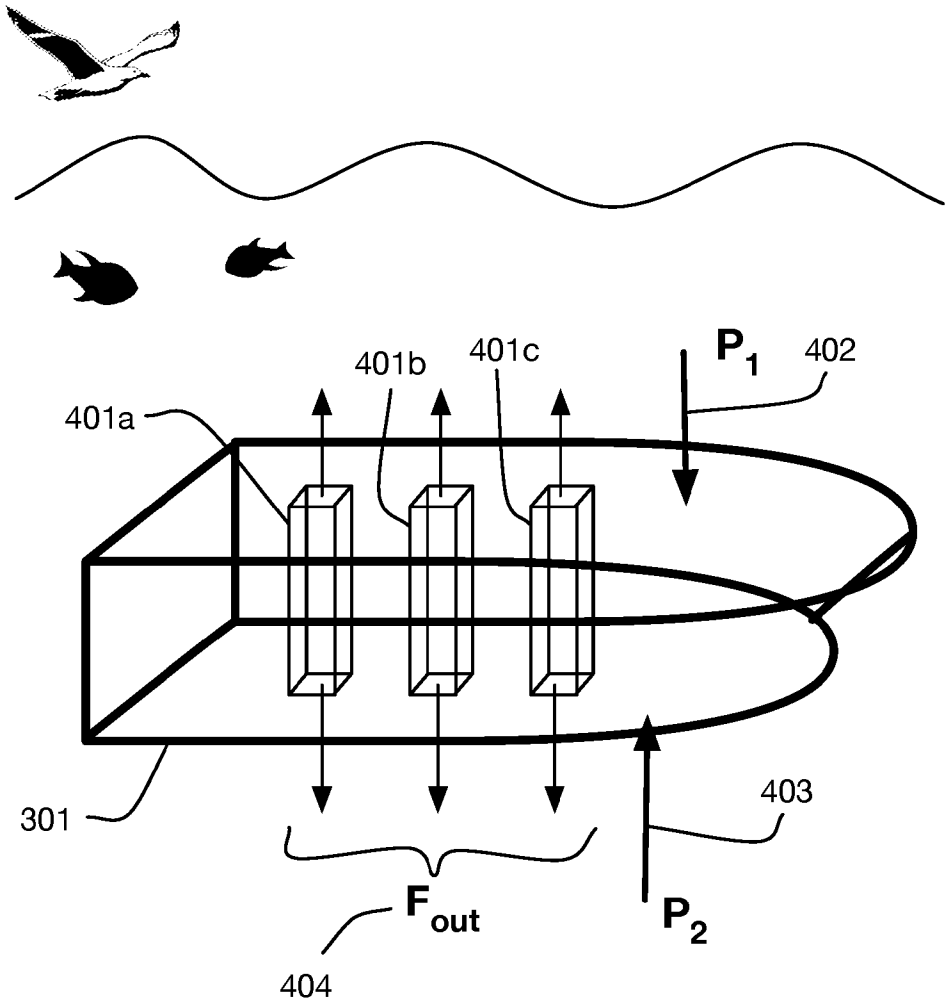
FIG. 4 illustrates an internal support structure within a pressure hull, which provides resistance against external water pressure.

While the noncircular pressure hull shape (as illustrated for example in FIG. 3) provides hydrodynamic efficiency, it has lower inherent rigidity against external pressure than the traditional hulls like the cylindrical and spherical hulls of FIG. 2. Therefore, one or more embodiments of the system may incorporate internal support structures inside the pressure hull to increase pressure resistance. These support structures may be of any size and shape. FIG. 4 shows an illustrative support structure inside pressure hull 301 of FIG. 3. This illustrative support structure includes three columns 401*a*, 401*b*, and 401*c*, each of which runs between the upper surface of the hull and the lower surface. The columns provide compressive resistance to improve the pressure hull's ability to withstand the external water pressure 402 and 403 on the upper and lower surfaces respectively. For example, the columns 401*a*, 401*b*, and 401*c* provide outward force 404 at the bottom surface to counteract pressure 403. The three vertical columns shown in FIG. 4 are illustrative; one or more embodiments may use any number of columns or other support structures in any orientation. For example, without limitation, support structures may include any combination of beams, columns, struts, trusses, walls, panels, ribs, and frames. These structures may be attached to any portion of the inner surface of the pressure hull. In one or more embodiments the support structures may be continuous with the pressure hull, for example if the pressure hull and the support structure are manufactured as a single part. One or more embodiments may use support structures that meet the inner surface of the pressure hull at at least two points, and that provide compressive resistance against external pressure that would otherwise move those two points towards each other. Support structures may be in any orientation, including vertical (as shown in FIG. 4), horizontal, diagonal, or any combination thereof.

Figure 5:
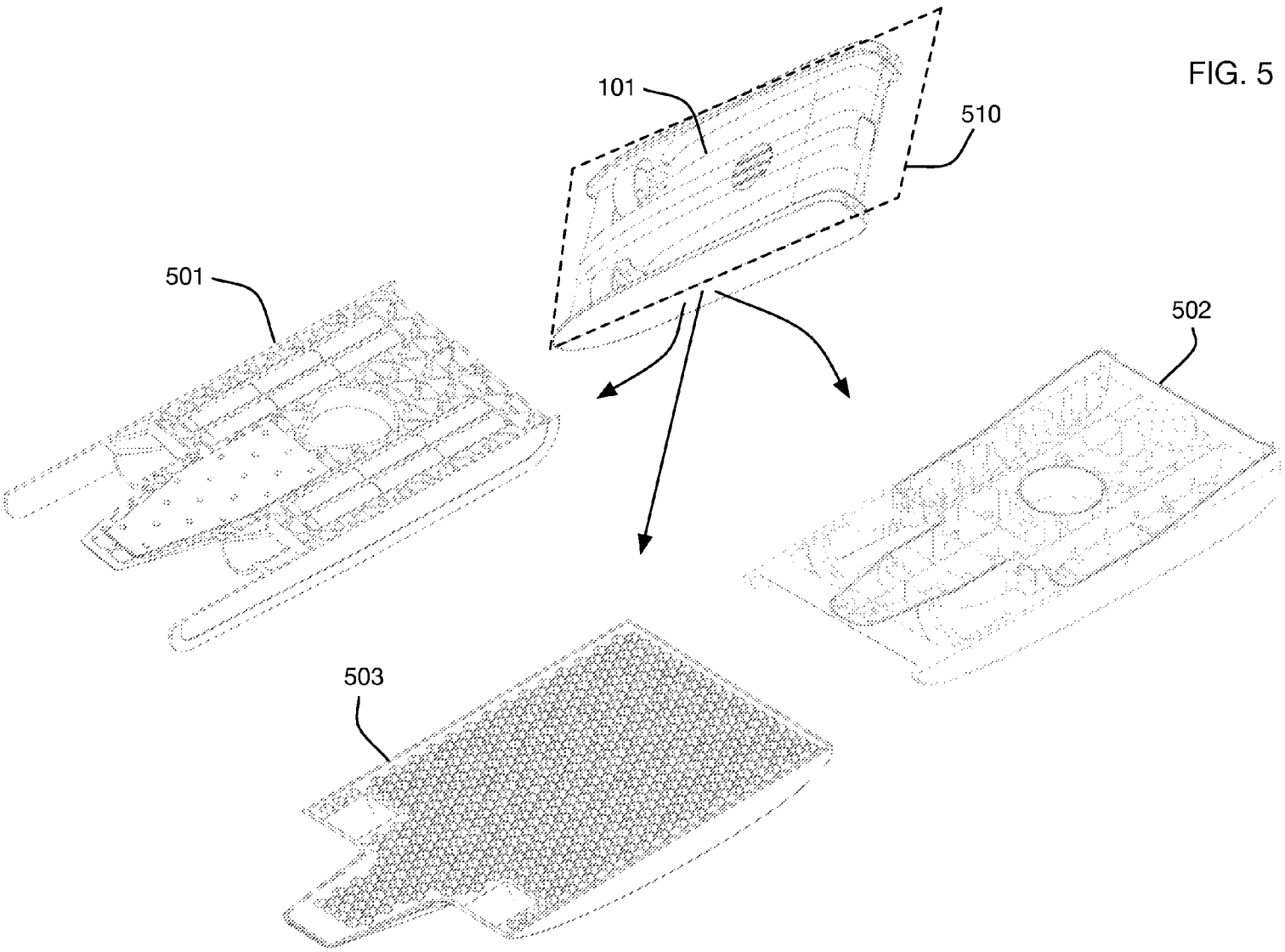
FIG. 5 shows three illustrative internal lattice structures within a pressure hull, including a triangular lattice, a rectangular lattice, and a hexagonal lattice.
Figure 6:
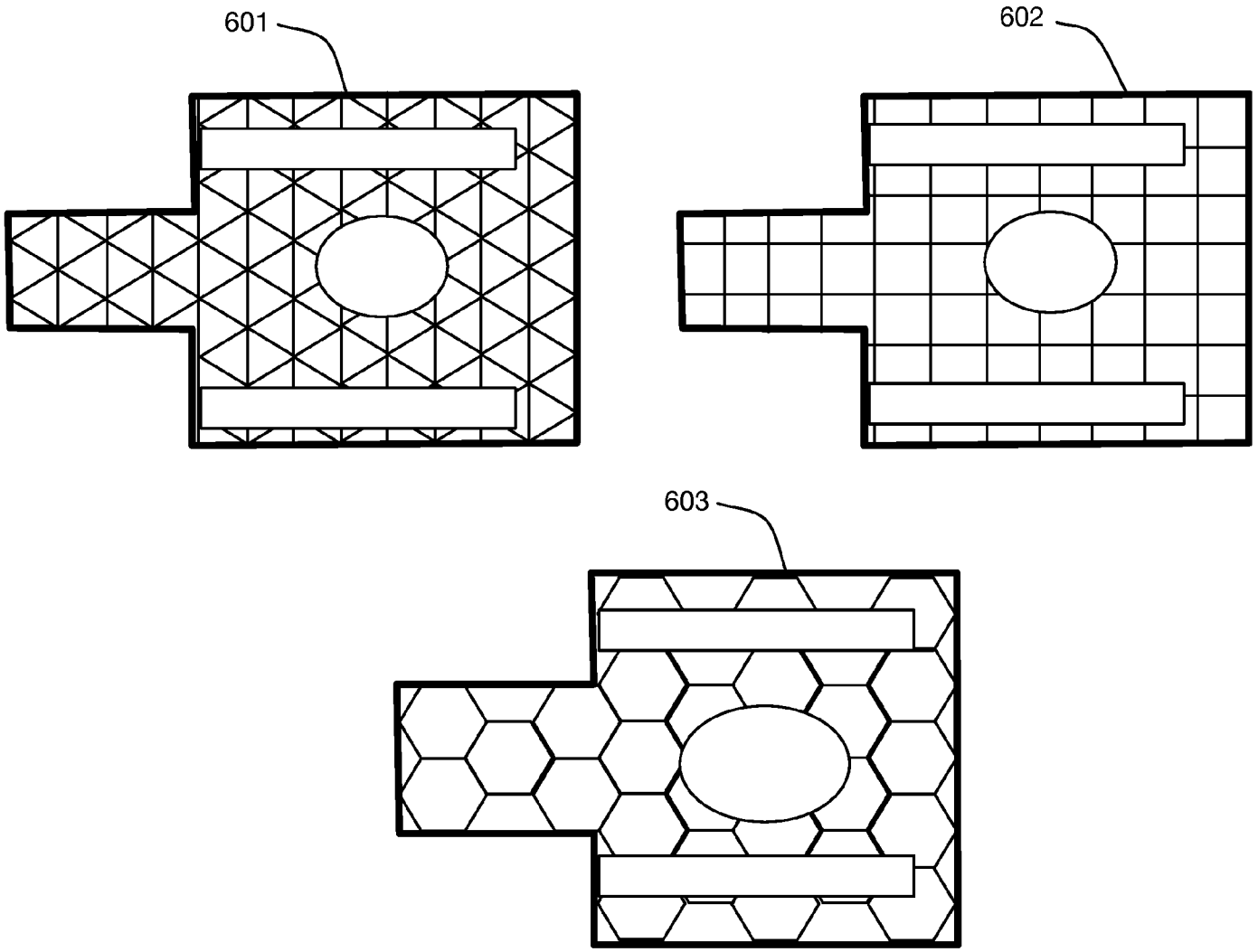
FIG. 6 is a conceptual cross sectional view of the three types of lattice structures shown in FIG. 5.

In one or more embodiments an internal support structure within a pressure hull may be organized in a lattice pattern. FIGS. 5 and 6 show illustrative lattice structures. FIG. 5 shows submersible vehicle 101 of FIG. 1, with three illustrative internal lattice patterns 501, 502 and 503. The views 501, 502 and 503 are cross sectional views with respect to plane 510. Lattice pattern 510 comprises a triangular lattice pattern of support walls and ribs inside the pressure hull. Some internal cavities are also shown in this view. Lattice pattern 502 comprises a rectangular lattice pattern of support walls and ribs, again showing some internal cavities. Lattice pattern 503 is a dense hexagonal lattice pattern of support walls, with most internal cavities not shown. One or more embodiments may use lattices of any size and shape; the triangular, rectangular, and hexagonal patterns are illustrative. Lattice patterns need not be regular. One or more embodiments may have mixed lattices with various shapes, for example a combination of rectangular lattice walls in one area and hexagon lattice walls in another area. In one or more embodiments the lattice may comprise columns, beams, ribs, trusses, frames, or other support members instead of or in addition to walls.

FIG. 6 illustrates a simplified two-dimensional view of the lattice patterns described in FIG. 5. Again these patterns are illustrative. Pattern 601 is a triangular lattice; pattern 602 is a rectangular lattice; and pattern 603 is a hexagonal lattice. One or more embodiments may use lattice patterns with large number of repeated shapes such as the triangles, rectangles, and hexagons of 601, 602, and 603 respectively. For example, the lattice pattern 602 has more than 50 rectangles, and it has more than 30 internal vertices (corners of the rectangular walls that are inside the outer edge of the pressure hull). The density of the lattice structure in an embodiment may be selected to provide the desired rigidity of the pressure hull, while also minimizing the required material for reduced weight and cost.

Use of an internal lattice support structure like for example those of FIGS. 5 and 6 allows the pressure hull and the support structure to be constructed from lightweight and inexpensive material such as plastic, while still providing sufficient pressure resistance. In one or more embodiments portions of the pressure hull, of the support structure, or of both may be made of injection molded plastic. Injection molding offers considerable cost savings for high volume production. However, efficient injection molding typically requires relatively thin walls or other structures, which limits the thickness of the pressure hull and of internal support walls. For example, design rules for injection molded plastic parts typically favor wall thickness in the range of approximately 1.5 mm to 5 mm. By using an internal support lattice, potentially with a relatively large number of support polygons and support vertices, one or more embodiments can achieve the cost efficiencies of injection molding while also obtaining sufficient rigidity of the structure to withstand underwater pressures. This approach to submersible vehicle design is not known in the art.

For example, without limitation, one or more embodiments may have a pressure hull with a maximum wall thickness of 10 mm or less. One or more embodiments may have a pressure hull with a maximum wall thickness of 7 mm or less. One or more embodiments may have a pressure hull with an average wall thickness of 7 mm or less. One or more embodiments may have a pressure hull with an average wall thickness of 4 mm or less. These designs with relatively thin walls, potentially constructed using injection molded plastic, may be able to withstand considerable pressures, such as for example, without limitation, up to 1200 kPa. One or more embodiments may be able to withstand pressures up to 2400 kPa or more. As an illustrative example, without limitation, one or more embodiments may have a pressure hull with an average thickness of 4 mm, and also be able to withstand pressure of up to 1200 kPa. This combination of a thin-walled pressure hull made of plastic and ability to withstand a high external pressure is possible in part because of an optimally designed internal support lattice. The design may be optimized for example using finite element analysis to calculate the deflection of each portion of the pressure hull under varying external pressure conditions.

Figure 7:
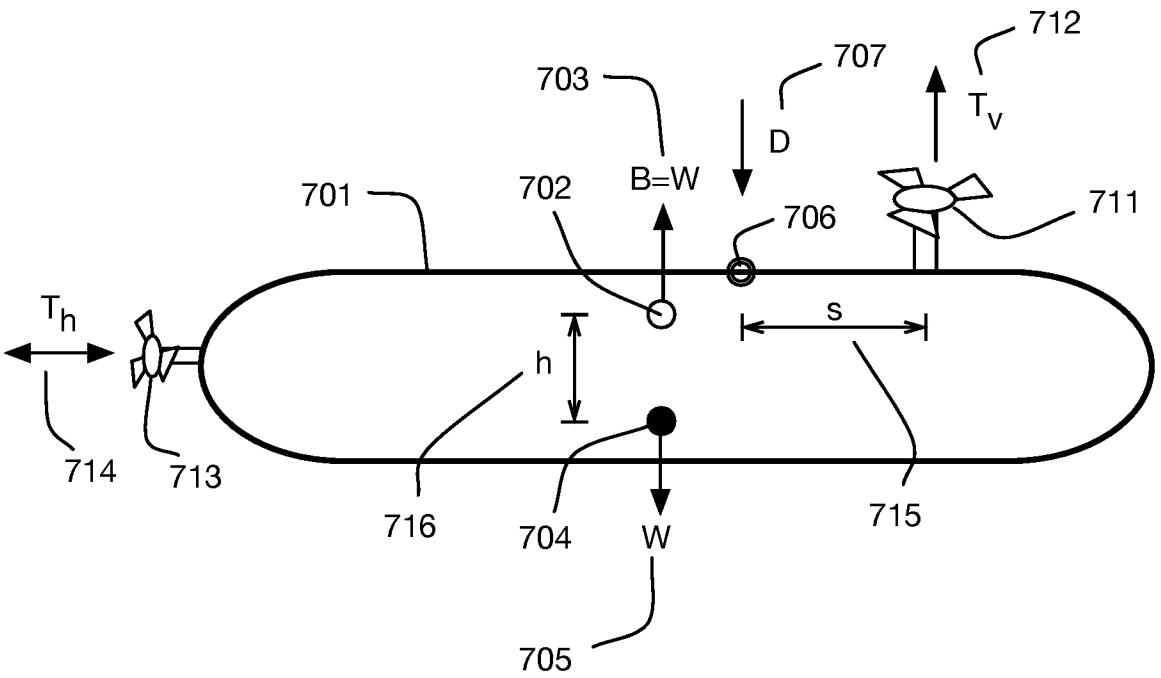
FIG. 7 illustrates the placement of thrust actuators in one or more embodiments of the system.

Hydrodynamic efficiency of a submersible vehicle is increased when the vehicle can be pointed in an orientation to minimize the coefficient of drag in the direction of travel. In general, this objective requires that the vehicle have actuators to change the pitch of the vehicle as it moves. While pitch control can be achieved with dedicated pitch actuators, one or more embodiments may achieve pitch control using an innovative design with a single vertical thrust actuator offset from the center of vertical drag. FIG. 7 illustrates a design for one or more embodiments with such a single vertical actuator. Pressure hull 701 of the submersible vehicle has center of mass 704 (which includes the vehicle's payload) and center of buoyancy 702. In this illustrative example, the vehicle is designed to be neutrally buoyant, so that the upward buoyancy force B 703 is equal and opposite to the weight W 705. The center of buoyancy 702 is located directly vertically above the center of mass 704, so that the vehicle is horizontal (no pitch angle) when it is not moving. The center of buoyancy and the center of mass are separated vertically by distance h 716. The vehicle has one or more horizontal thrust actuators 713 that provide forward and backward thrust 714. The vehicle has at least one vertical thrust actuator 711 that provides upwards or downwards thrust 712. When the vehicle moves vertically up or down, it experiences a vertical drag force from the water. The drag force is distributed over the surface of the vehicle, but it is equivalent to a single vertical drag force D 707 acting at a position 706 on the vehicle's surface, which we refer to as the center of vertical drag. (The center of vertical drag for upward motion may in some embodiments be different from the center of vertical drag for downward motion; for simplicity FIG. 7 and the discussion below focuses on the case of upward motion of the vehicle. The case of downward vertical motion is analogous, although the specific values for torques, forces, and offsets may be different.) The vertical actuator 711 is offset horizontally from the center of vertical drag 706 by distance 715. In this illustrative example, the vertical actuator is forward of the center of vertical drag; in one or more embodiments the vertical actuator may be behind the center of vertical drag. The illustrative design shows a single vertical actuator; one or more embodiments may employ multiple vertical actuators, using similar principles (described below) to achieve variable pitch control.

Figure 8:
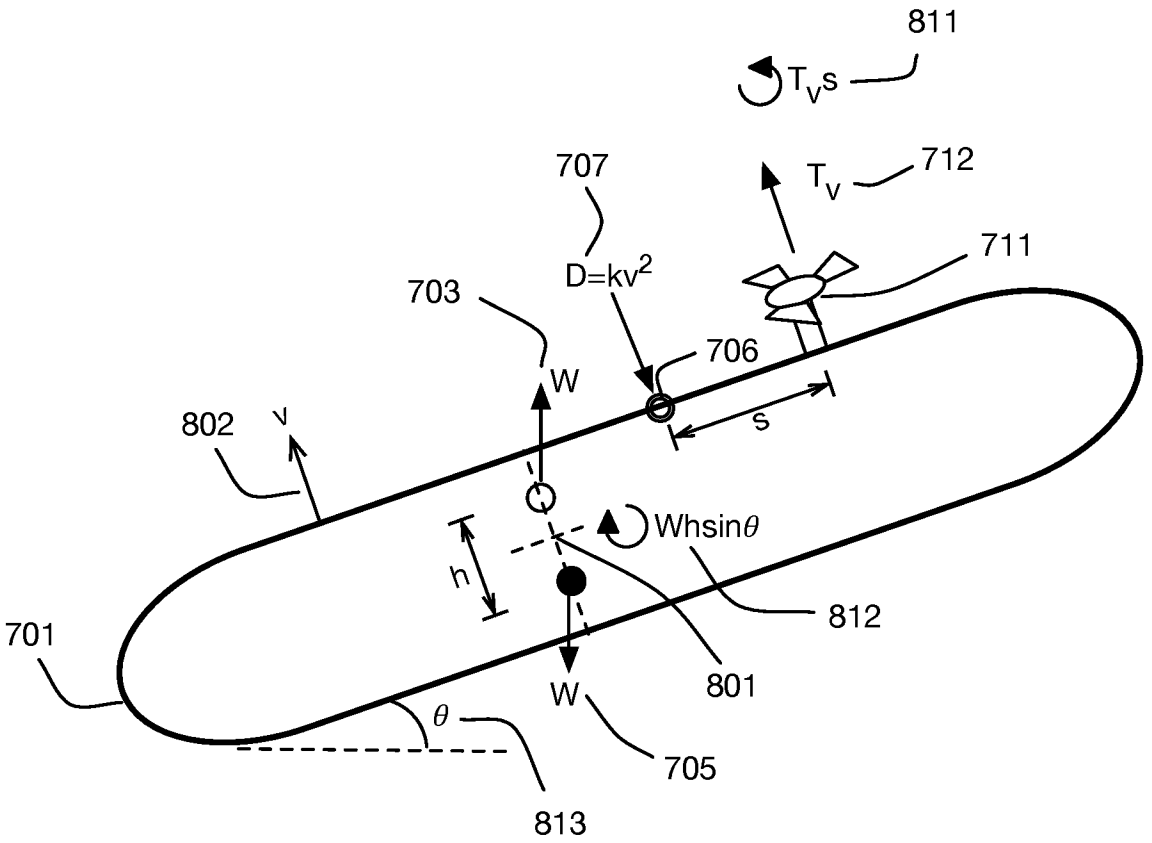
FIG. 8 illustrates the forces and torques provided by the actuator placement of FIG. 7, which can provide both vertical lift and pitch control.

FIG. 8 illustrates forces and torques on the vehicle of FIG. 7 while it is moving. (Horizontal forces and horizontal motion are not shown in this example for simplicity.) For illustration, the vehicle is shown moving upwards. Vertical thrust $T_v$ 712 generates upward acceleration. The water generates a countervailing drag force D 707, which in general is roughly proportional to the square of the upward speed 802. Force 707 also depends on the coefficient of drag of the vehicle in the direction of motion. The drag force D is applied at the center of vertical drag 706. The vehicle accelerates until the upward thrust 712 and the drag force 707 are equal in magnitude. Because the vertical thrust actuator 711 is offset horizontally from the center of vertical drag, i.e., by offset s as shown, the vertical thrust 811 and the drag 707 generate a net torque 811 that causes the vehicle to pitch upwards at angle 813. (Since the magnitudes of force 712 and 707 are equal, and they are in opposite directions, they form a couple with a net torque equal to 811 around any origin. In particular, the torque 811 equals the torque of the vertical thrust force 712 around the center of vertical drag 706.) When the vehicle pitches upwards, the combination of the buoyancy force 703 and the weight 705 generate a righting moment 812, which counteracts the torque 811. The pitch grows until the righting moment 812 and the torque 811 are equal in magnitude. When these torques 811 and 812 are equal in magnitude, and when forces 712 and 707 are equal in magnitude, the submersible vehicle is in dynamic equilibrium. Because of the horizontal offset between the vertical thrust actuator 711 and the center of vertical drag 706, this dynamic equilibrium has a nonzero vertical pitch angle 813. The pitch 813 of the vehicle can therefore be controlled using the vertical thrust actuator 711.

Figure 9:
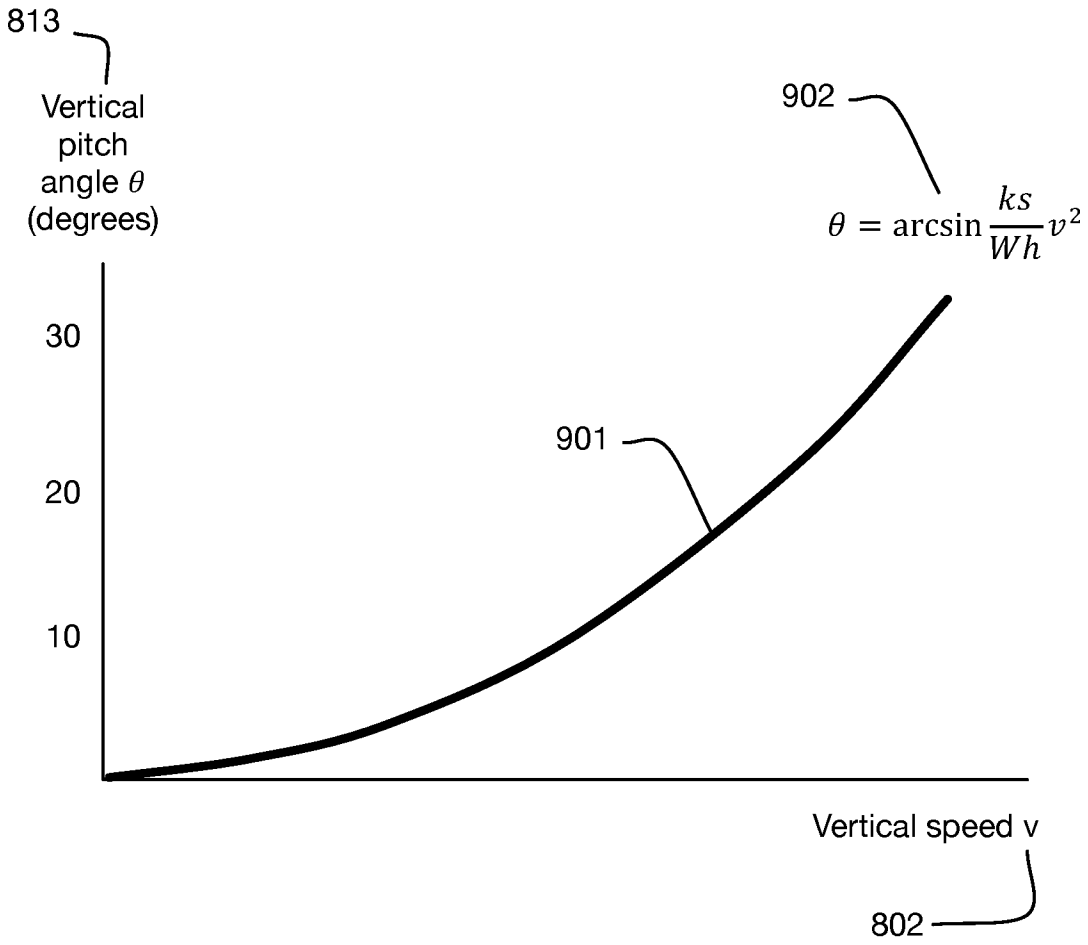
FIG. 9 shows an illustrative curve for the actuator design of FIG. 7, which relates pitch angle and vertical speed.

FIG. 9 illustrates this pitch control. Using the parameters illustrated in FIG. 8, the dynamic equilibrium occurs when $Wh \sin\theta = T_v s$, and when $T_v = kv^2$. Thus $$\theta = \arcsin\frac{ks}{Wh}v^2.$$

This relationship 902 between the pitch angle 813 and the vertical speed 802 is illustrated in curve 901 of FIG. 9. When the vertical speed is small, the pitch angle is very small, but it grows approximately quadratically with increasing vertical speed. This curve 901 provide a remote operator with significant control over the vertical pitch angle 813, using the single vertical thrust actuator. The specific relationship 902 and the curve 901 are illustrative for the simple model shown in FIG. 8. However, in general the offset of the vertical thrust actuator from the center of vertical drag provides a combination of vertical speed control and pitch angle control using a single actuator (or a group of actuators at offset locations). Embodiments of the invention thus differ from known devices that require thrusters forward and aft, or a single thruster located vertically about the center of vertical drag 706, which focused on keeping the apparatus level. Any design that provides combined speed and pitch control using an offset actuator is in keeping with the spirit of the invention.

Figure 10:
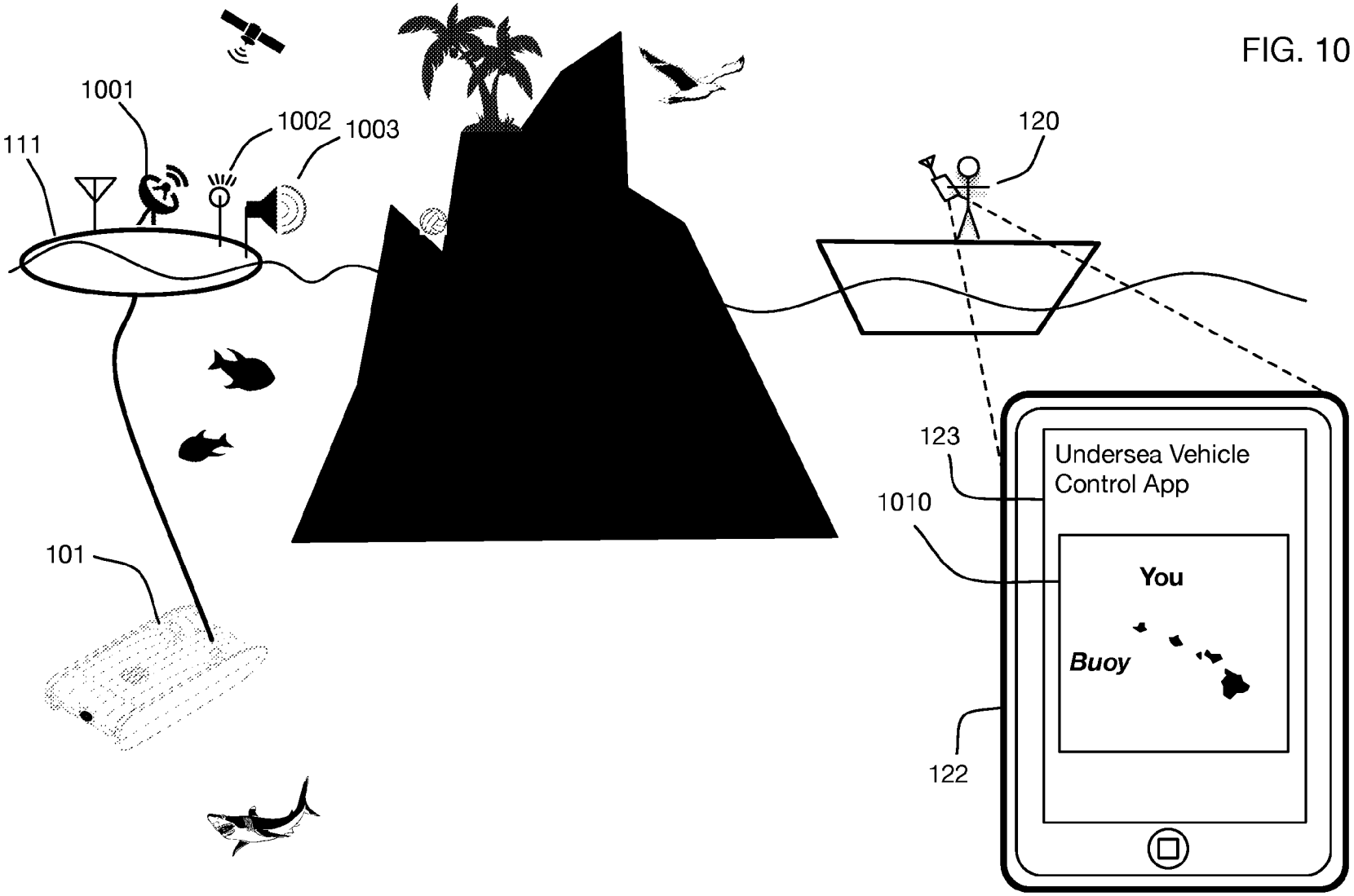
FIG. 10 illustrates an embodiment of the system that includes a GPS locator and a beacon light on the communications buoy, to assist with locating the vehicle.

In one or more embodiments that use a communications buoy to relay signals between the submersible vehicle and a remote operator station, the buoy may have one or more components that assist in locating the vehicle. Because the vehicle in this case is not directly tethered to the remote operator, it may be possible for the vehicle (and its buoy) to travel a great distance from the operator. In some cases, it may therefore be difficult for the operator to locate the vehicle (and its buoy) visually. FIG. 10 illustrates an example with vehicle 101 and buoy 111 on the other side of an island from remote operator 120. To assist the operator in locating the submersible vehicle, the buoy 111 may for example have a GPS receiver 1001. The buoy can then report its location via wireless communication to the operator 120. For example, the remote operator station 122 may include in its control app 123 a map such as map 1010 that shows the location of the buoy relative to the location of the operator. In one or more embodiments the communications buoy 111 may also include a locator beacon 1002 that may for example emit or flash a light to facilitate locating the buoy. In one or more embodiments the communications buoy 111 may also include a locator siren or speaker 1003 that sends an audible signal to facilitate locating the buoy.

Figure 11:
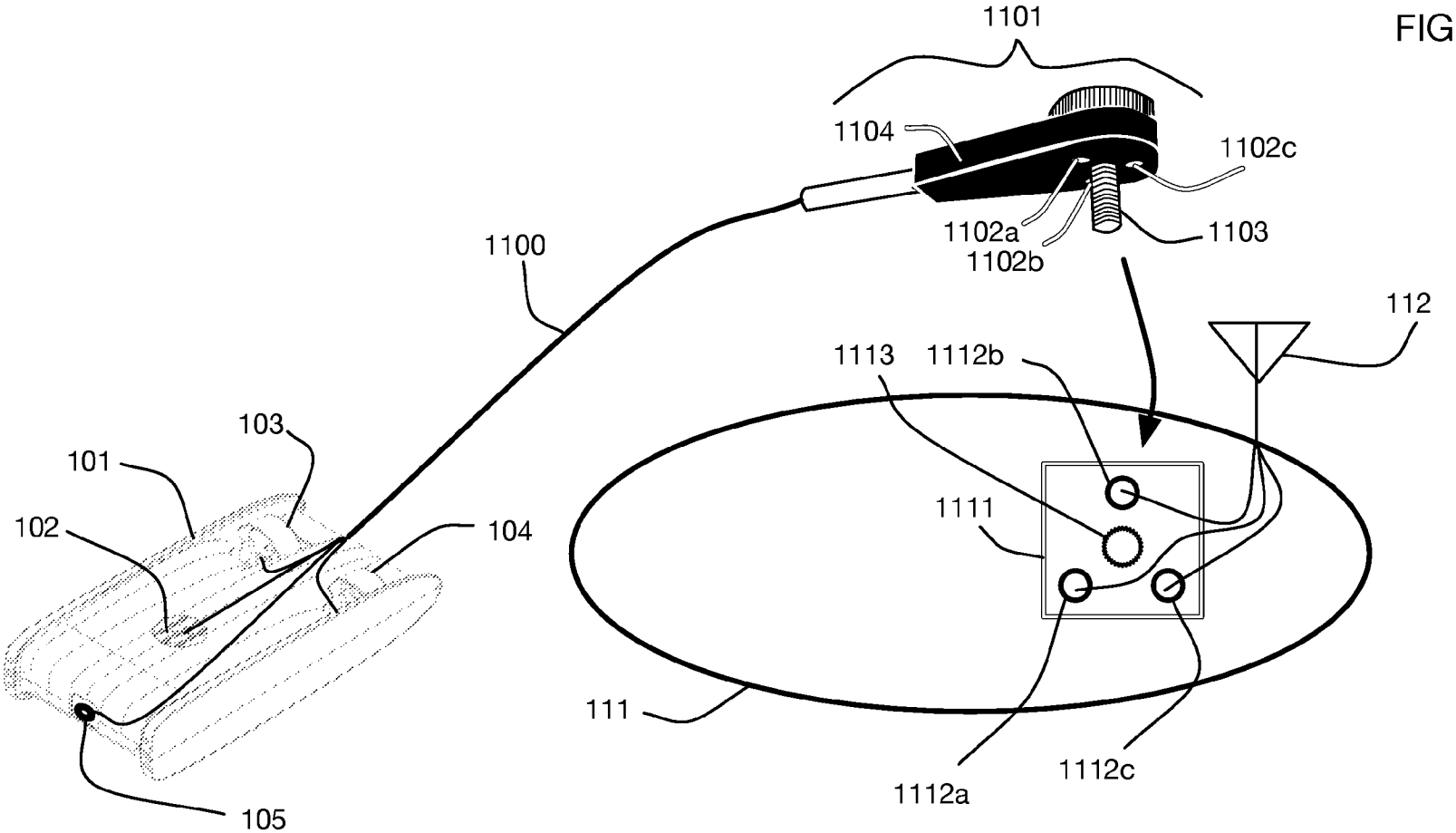
FIG. 11 illustrates a connector used in one or more embodiments of the system, for example to connect a cable from the vehicle to the communications buoy.

One or more embodiments of the system may use one or more rugged electrical connectors that are designed to work effectively in the underwater environment. In particular, one or more embodiments may use an innovative connector design that embeds terminals in a compliant, water-resistant material, and seals a connection when the connector is pressed against a receiving set of terminals. FIG. 11 illustrates an embodiment with a specialized connector 1101 to connect communications cable 1100 from submersible vehicle 101 to communications buoy 111. The cable 1100 is connected to actuators and sensors on the submersible vehicle, such as for example thrust actuators 102, 103, and 104, and camera 105. At the buoy end of the cable, connector 1101 can be connected to mating panel 1111 on the buoy. Connector 1101 is a waterproof, genderless, high-cycle life, low cost, load bearing connector. It provides consistent contact pressure between mating conductors to maintain a conductive path. In many traditional connectors known in the art, this pressure is achieved through means of a spring which is deflected upon introduction to its reciprocal part. For mating electrical connectors intended to be used underwater, this requirement for spring deflection presents a problem because the space into which the spring deflects must be left empty and is then subject to flooding or structural failure from surrounding water pressure when submerged. Connector 1101 requires no spring, and therefore is not subject to this problem. The connector is placed against mating panel 1111 and is secured by tightening thumbscrew 1103 through receiving hole 1113 in the panel. Connector 1101 has three terminals that are enclosed in the sealing pad 1104; the holes 1102*a*, 1102*b*, and 1102*c* in the bottom surface of the sealing pad expose the bottom surface of these terminals when the sealing pad is compressed. Tightening of screw 1103 presses the terminals in recessed holes 1102*a*, 1102*b*, and 1102*c* against mating conductors 1112*a*, 1112*b*, and 1112*c*, respectively. The compliant sealing pad 1104 forms a waterproof seal around the conductive paths. The conductors 1112*a*, 1112*b*, and 1112*c* may for example be connected to wireless transmission circuitry that sends and receives data over antenna 112 of the buoy. The connector design 1101 is particularly effective with three or fewer terminals, since the ends of the terminals can therefore be guaranteed to be coplanar, thus eliminating the potential for wobbling and thereby ensuring engagement of the pins and a good connection when the connector is pressed against the receiving panel. This wobble-free connection is similar to the stability of a three-legged stool compared to that of a stool with four or more legs; with three legs the ends of the legs are always coplanar and each leg fully engages with the floor.

Figure 12:
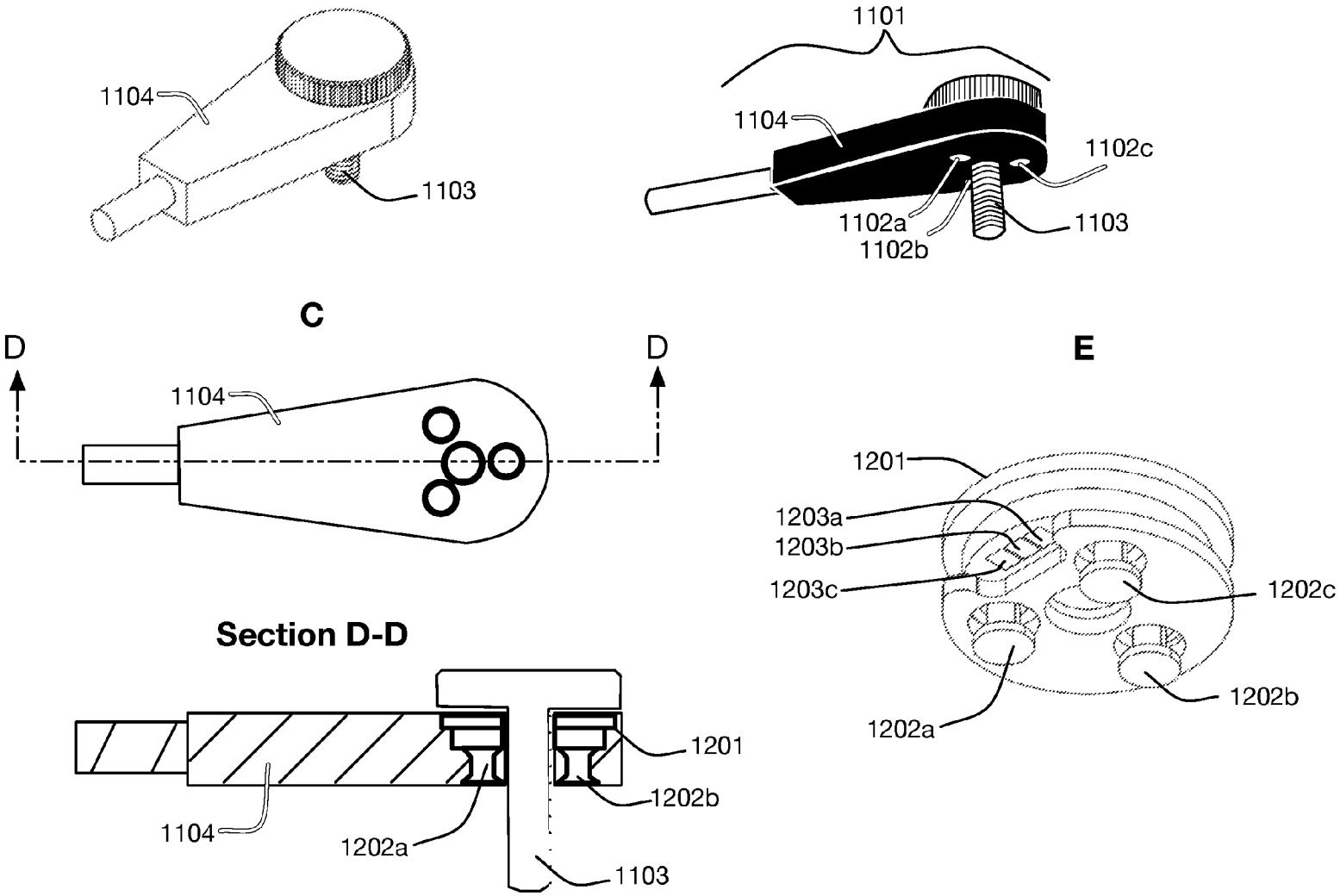
FIG. 12 shows several views of the connector illustrated in FIG. 11.

FIG. 12 shows several additional views of connector 1101. View A is a top perspective view, showing the compliant sealing pad 1104 and thumb screw 1103. The material for the seal 1104 may for example contain over-molded rubber, or more generally may contain any water-resistant, compliant material or materials. View B is a bottom perspective view, showing the holes 1102*a*, 1102*b*, and 1102*c* through the seal 1104 that provide access to the terminals.

View C is a bottom view of the connector, with the thumb screw 1103 removed, showing the center hole through which the thumb screw passes, and the three holes that expose the conductors for attachment to mating conductors. Section D-D is a cross section view that shows the internal components 1201 for the electrical connections; two of the three terminals, 1202*a* and 1202*b*, are visible (with the third hidden by the thumbscrew 1103). View E is a close-up bottom perspective view of the electrically conductive components that are encased in the sealing pad 1104. Terminals 1202*a*, 1202*b*, and 1202*c* are connected (for example via an internal circuit board) to leads 1203*a*, 1203*b*, and 1203*c*, respectively. The cable's conductive wires can then be attached (for example crimped, or soldered) to these leads. In this illustrative example, outer mating surfaces of the terminals 1202*a*, 1202*b*, and 1202*c* are flat and are coplanar; these surfaces press against mating conductors with pressure provided via the center screw 1103.

Figure 13:
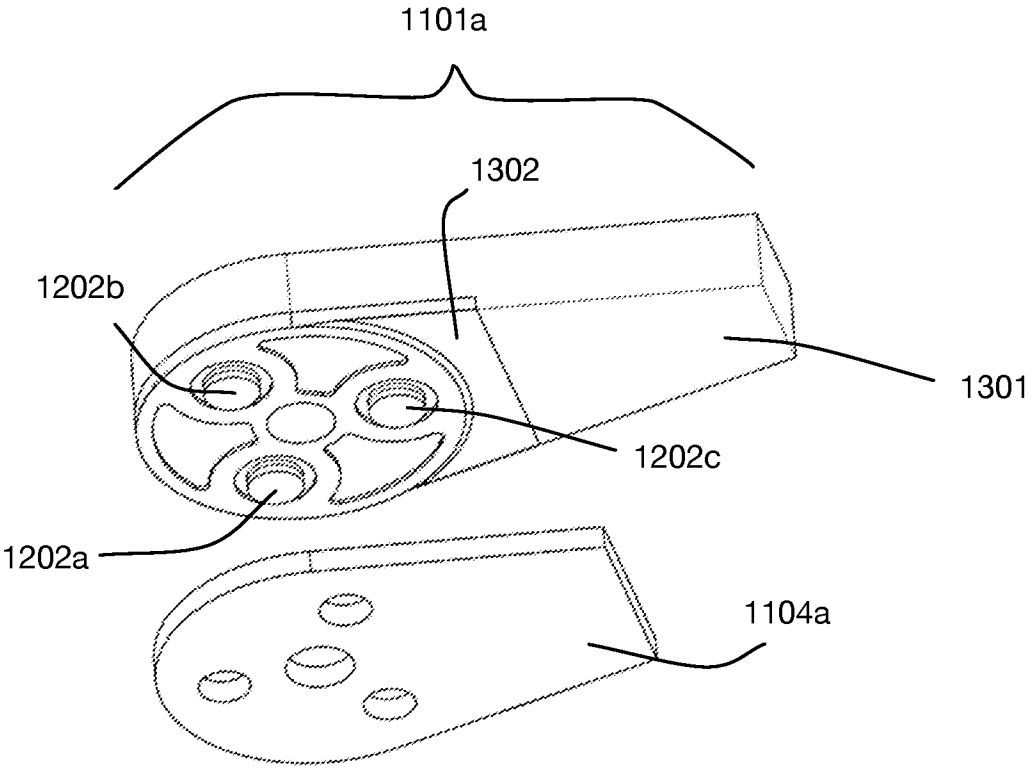
FIG. 13 shows a different embodiment of the connector illustrated in FIG. 11, which uses a sealing pad that is separate from the connector body.

In the embodiment illustrated in FIG. 12, the sealing pad 1104 surrounds the entire body of the connector. FIG. 13 illustrates a different embodiment of the connector with a sealing pad that is separate from the connector body. In the embodiment of FIG. 13, connector 1101*a* includes a body 1301 and a separate sealing pad 1104*a* that is made of a compliant material such as rubber. (The screw of the connector is not shown in this diagram, but it is similar to the screw 1103 in FIG. 12.) Body 1301 has a recessed area 1302 into which pad 1104*a* fits. Pad 1104*a* has holes to expose the terminals 1202*a*, 1202*b*, and 1202*c*. A connector with a separate sealing pad component provides a potential benefit that the sealing pad can be more easily replaced; it may also reduce the amount of compliant material required for the connector.

In one or more embodiments the motors driving the thrust actuators may be designed specifically for underwater operation. One or more embodiments may use brushless motors because these motors have no exposed conductors (such as the brush and commutator that would be found in a brushed motor); therefore no electrical shorting can take place if the motor is flooded. The brushless motors may therefore be flooded (allowing surrounding water to permeate all cavities), which allows them to operate without the need of shaft seals. Flooding also allows the motors to operate at extraordinary depths since they entire system equalizes to ambient pressure. In one or more embodiments, "outrunner" brushless motors may be preferred over "inrunner" motors because outrunners generally provide greater amounts of torque for a given amount of power, and are often easier to disassemble for maintenance purposes. However, a potential problem with running brushless outrunner motors in water is that suspended particles from the outside environment may wander into the motor and lodge themselves between the stator and bell of the motor which can reduce torque and increase wear.

Figure 14:
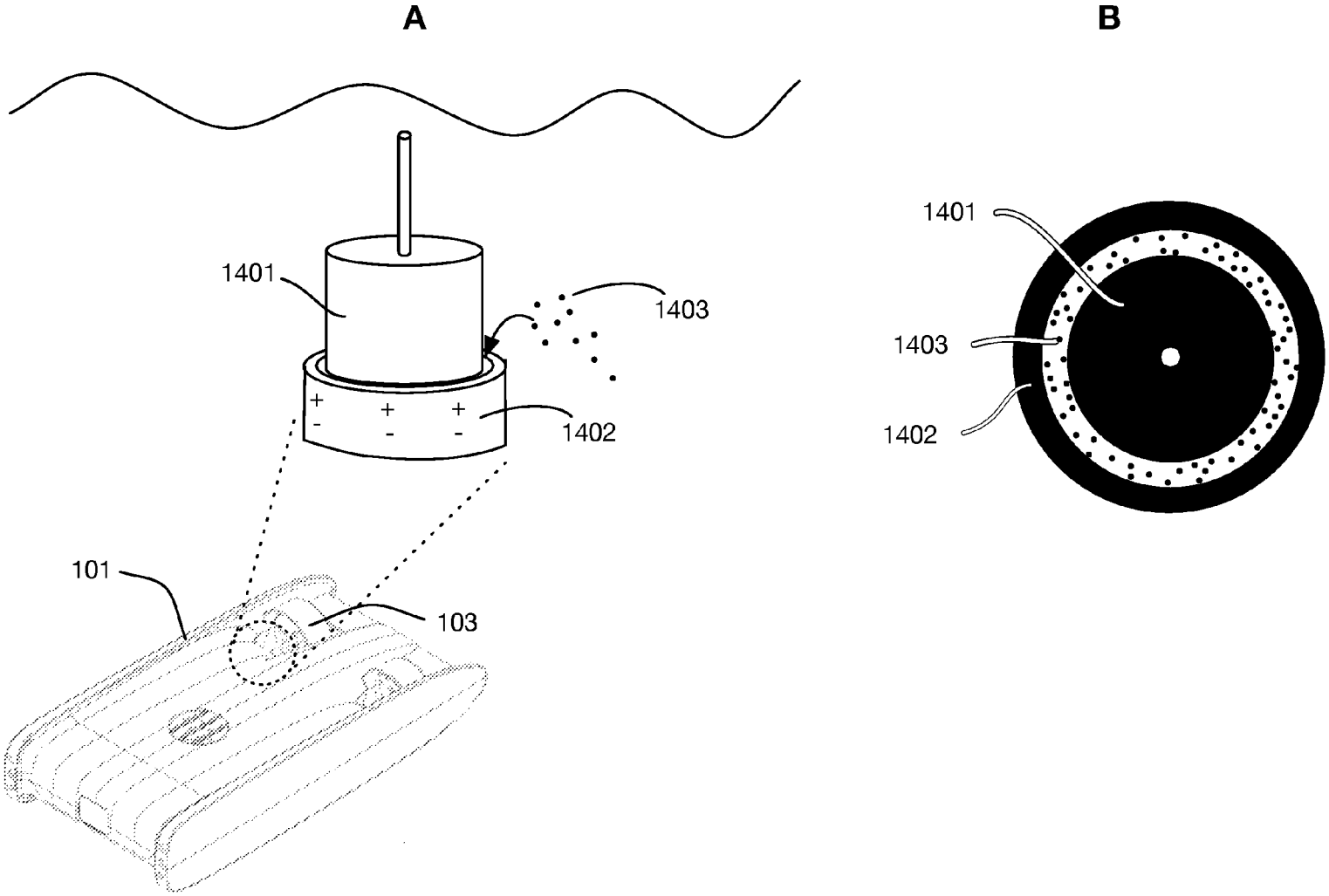
FIG. 14 shows perspective and top views of a magnetic filter around a DC motor that may for example drive a propeller of a remotely operated submersible vehicle.

FIG. 14 illustrates a solution to the ingress of particles into motors that may be used in one or more embodiments. View A of FIG. 14 shows a perspective view of a motor that may drive for example thrust actuator 103 of remotely operated underwater vehicle 101. (The actuator 103 is for illustration; the motor filter design described below may be used with any actuator or actuators on the system.) The motor shown has a rotating outer bell 1401 and a stator (not shown) enclosed within this rotating bell. Because the motor is submerged and may be flooded as described above, suspended particles 1403 in the water could potentially enter the motor and interfere with the motor's operation. Therefore, one or more embodiments may add a magnetic filter 1402 around the outside surface of the bell 1401. This filter 1402 may be for example a ring magnet, with either axial polarization (as illustrated) or radial polarization. By placing the polarized ring magnet 1402 around the outside of outrunner brushless motor bell 1401, one or more embodiments may reduce intrusion of particles 1403 to prevent adverse effects on the motor's performance and longevity. The magnetic filter may capture ferrous particles that might otherwise be pulled into the motor, since these particles are attracted to the magnetic ring 1402. In addition, the ferrous buildup between the magnetic ring 1402 and the motor bell 1401 may also potentially filter nonferrous materials that might otherwise be pulled into the motor, by using the ferrous buildup as a mechanical filter. In one or more embodiments the only opening to the inside of the brushless motor may be the gap below the motor bell 1401, which is surrounded by ring magnet 1402. This design also has the advantage over other mechanical filters (such as a brush or felt-like material that rubs against the bell) because it produces much less friction against the motor bell as a result of the ferrous particles being moved until they have almost zero normal force against the motor.

View B of FIG. 14 shows a top view of the motor bell 1401 and the ring magnet 1402. Particles 1403 accumulate in the gap between the outer surface of motor bell 1401 and the inner surface of ring magnet 1402, rather than entering the motor bell.

While the invention herein disclosed has been described by means of specific embodiments and applications thereof, numerous modifications and variations could be made thereto by those skilled in the art without departing from the scope of the invention set forth in the claims.

What is claimed is:

1. A lattice structure equipped hydrodynamic submersible remotely operated vehicle comprising:

a pressure hull having a noncircular cross section along all cutting planes that bisect an interior of said pressure hull;

an internal support frame inside said pressure hull comprising a lattice of inner support walls, inner support columns, or both inner support walls and inner support columns, wherein said internal support frame is in contact with an inner surface of said pressure hull at a plurality of support points on both sides of any plane that bisects said interior of said pressure hull;

said lattice comprises a dense lattice of a selected density with a plurality of repeated polygons;

a cross-section of said lattice with some plane comprises at least 20 vertices, wherein said vertices comprise corners of the inner support columns or the inner support walls or both the inner support columns and the inner support walls that are inside an outer edge of the pressure hull;

said density is selected to provide a desired rigidity of the pressure hull;

a majority by volume of said pressure hull comprises injection molded plastic;

a majority by volume of said internal support frame comprises injection molded plastic; and, said internal support frame provides a resistive force against compression of said pressure hull when said pressure hull is submerged;

one or more actuators coupled to said pressure hull that provide propulsion to move said pressure hull when said pressure hull is submerged;

one or more sensors coupled to said pressure hull that generate observations of a surrounding environment when said pressure hull is submerged; and, communications electronics coupled to said one or more actuators, to said one or more sensors, and to a remote operator, and configured to receive signals from said remote operator containing control commands for said one or more actuators; and, transmit signals to said remote operator containing said observations of said surrounding environment.

2. The lattice structure equipped hydrodynamic submersible remotely operated vehicle of claim 1, wherein said pressure hull is neither cylindrical nor spherical.

3. The lattice structure equipped hydrodynamic submersible remotely operated vehicle of claim 1, wherein said lattice is a triangular lattice or a hexagonal lattice or a rectangular lattice.

4. The lattice structure equipped hydrodynamic submersible remotely operated vehicle of claim 1, wherein a maximum thickness of said pressure hull is less than 10 millimeters.

5. The lattice structure equipped hydrodynamic submersible remotely operated vehicle of claim 1, wherein a maximum thickness or an average thickness of said pressure hull is less than 7 millimeters.

6. The lattice structure equipped hydrodynamic submersible remotely operated vehicle of claim 1, wherein an average thickness of said pressure hull is less than 4 millimeters.

7. The lattice structure equipped hydrodynamic submersible remotely operated vehicle of claim 1, wherein said pressure hull and said internal support frame maintain structural integrity when subjected to an external pressure of 1200 kPa.

8. The lattice structure equipped hydrodynamic submersible remotely operated vehicle of claim 1, wherein said pressure hull and said internal support frame maintain structural integrity when subjected to an external pressure of 2400 kPa.

9. The lattice structure equipped hydrodynamic submersible remotely operated vehicle of claim 1, wherein said one or more actuators comprise a single vertical thruster located horizontally fore of or aft of a center of vertical drag of said remotely operated vehicle including its payload; and, said single vertical thruster provides both a vertical force to move said remotely operated vehicle vertically when said remotely operated vehicle is submerged, and a torque around said center of vertical drag to change a pitch of said remotely operated vehicle when said remotely operated vehicle is submerged.

10. The lattice structure equipped hydrodynamic submersible remotely operated vehicle of claim 9, wherein a maximum value of said torque around said center of vertical drag is greater than or equal to a righting moment of said remotely operated vehicle when said pitch is 15 degrees.

11. The lattice structure equipped hydrodynamic submersible remotely operated vehicle of claim 9, wherein a maximum value of said torque around said center of vertical drag is greater than or equal to a righting moment of said remotely operated vehicle when said pitch is 30 degrees.

12. The lattice structure equipped hydrodynamic submersible remotely operated vehicle of claim 1, wherein said communications electronics comprises a signal cable coupled to said one or more actuators and to said one or more sensors; and, a communications buoy coupled to said signal cable, said communications buoy comprising an antenna that transmits wireless signals to said remote operator and that receives wireless signals from said remote operator.

13. The lattice structure equipped hydrodynamic submersible remotely operated vehicle of claim 12, wherein said communications buoy further comprises a locator light; and, a GPS receiver.

14. The lattice structure equipped hydrodynamic submersible remotely operated vehicle of claim 12, wherein said signal cable terminates in a waterproof surface contact connector that is detachably coupled to said communications buoy, said waterproof surface contact connector comprising three conductive terminals, each comprising an inbound connection to a conductor in said signal cable, each comprising a substantially flat outbound connecting surface at an end opposite said inbound connection, wherein the outbound connecting surfaces for all of said three conductive terminals are substantially coplanar; and, a sealing pad comprising a waterproof, insulating, compliant material, said sealing pad comprising a mating surface configured to be placed against a corresponding receiving surface of said communications buoy, and comprising an outer surface opposite said mating surface;

wherein said sealing pad surrounds each conductive terminal of said three conductive terminals and separates said three conductive terminals from one another;

said sealing pad comprises a corresponding hole in said mating surface for each conductive terminal that exposes said outbound connecting surface of said conductive terminal;

said sealing pad comprises a fastening hole through said outer surface extending to said mating surface;

said fastening hole is located inside a triangular region comprising said three conductive terminals as vertices;

said communications buoy comprises a receiving hole corresponding to said fastening hole; and, said waterproof surface contact connector is connected to said communications buoy by inserting a fastener through said fastening hole into said receiving hole and tightening said fastener to apply a load pressing said mating surface against said receiving surface, thereby establishing an electrical contact between said three conductive terminals and corresponding contacts on said communications buoy, and thereby establishing a water resistant barrier around said electric contact with said sealing pad.

15. The lattice structure equipped hydrodynamic submersible remotely operated vehicle of claim 1, wherein at least one of said one or more actuators comprise a brushless outrunner DC motor comprising a rotating motor bell; and, a ring magnet coaxial with said rotating motor bell, wherein said ring magnet surrounds a portion of an outer surface of said rotating motor bell with a gap between an inner surface of said ring magnet and said outer surface of said rotating motor bell;

wherein said ring magnet is either axially polarized or radially polarized.

* * * * *